US009198252B2

(12) United States Patent
Laski et al.

(10) Patent No.: US 9,198,252 B2
(45) Date of Patent: Nov. 24, 2015

(54) SYSTEM AND METHOD FOR CONTROLLING LIGHTING

(71) Applicant: OSRAM SYLVANIA Inc., Danvers, MA (US)

(72) Inventors: Joseph Laski, Stoneham, MA (US); Makarand Chipalkatti, Lexington, MA (US); Maria Thompson, Cheshire, CT (US)

(73) Assignee: OSRAM SYLVANIA INC., Wilmington, MA (US)

( * ) Notice: Subject to any disclaimer, the term of this patent is extended or adjusted under 35 U.S.C. 154(b) by 268 days.

(21) Appl. No.: 13/835,809

(22) Filed: Mar. 15, 2013

(65) Prior Publication Data

US 2014/0265882 A1 Sep. 18, 2014

(51) Int. Cl.
*H05B 33/08* (2006.01)

(52) U.S. Cl.
CPC ..... *H05B 33/0872* (2013.01); *H05B 33/0854* (2013.01); *H05B 33/0866* (2013.01)

(58) Field of Classification Search
CPC ..... H05B 33/0851; H05B 33/0854; H05B 33/0866; H05B 33/0872; G06K 9/4661; H04N 9/73
USPC ..... 315/158, 312; 345/426, 582, 589
See application file for complete search history.

(56) References Cited

U.S. PATENT DOCUMENTS

| | | | | |
|---|---|---|---|---|
| 5,710,876 | A * | 1/1998 | Peercy et al. | 345/426 |
| 7,075,643 | B2 * | 7/2006 | Holub | 356/326 |
| 2008/0238931 | A1 * | 10/2008 | Komiya et al. | 345/589 |
| 2009/0005657 | A1 * | 1/2009 | Bodlaender et al. | 600/301 |
| 2013/0039053 | A1 * | 2/2013 | Takakura et al. | 362/231 |
| 2014/0320667 | A1 * | 10/2014 | Densham et al. | 348/169 |

* cited by examiner

*Primary Examiner* — Douglas W Owens
*Assistant Examiner* — Syed M Kaiser
(74) *Attorney, Agent, or Firm* — Andrew Martin

(57) ABSTRACT

A system for controlling a light source to enhance the appearance of one or more objects within an environment illuminated by the light source. The system includes a tunable white light source to illuminate an object and a camera configured to capture one or more digital images the object and identify attributes of the object, including object color values. The system further includes a light control module configured to determine at least one optimal lighting condition for the light source based, at least in part, on the object attributes, wherein the optimal lighting condition is configured to enhance the appearance of the object illuminated by the light source while maintaining the overall appearance of light within the environment. The light control module is further configured to adjust the spectral composition of the light source based on the optimal lighting condition.

18 Claims, 4 Drawing Sheets

SYSTEM AND METHOD FOR CONTROLLING LIGHTING

CROSS-REFERENCE TO RELATED APPLICATIONS

Not applicable.

FIELD

The present disclosure relates generally to lighting systems, and, more particularly, to a system and method for controlling a light source to enhance the appearance of one or more objects illuminated by the light source.

BACKGROUND

In the lighting industry, the use of light emitting diodes (LEDs) has provided numerous benefits over the conventional lighting sources in a variety of applications. In particular, lamps have used LEDs as a light source to increase efficacy, i.e., lumens-per-watts (LPW), as compared to, for example, the relatively inefficient incandescent and fluorescent lamps. As such, LEDs may generally provide greater energy efficiency and increased lifespan. In addition, LEDs may also provide a greater range of controllability. For example, some LED-equipped lighting systems can be controlled so as to produce a range of different properties of light, adjustable to users' requirements for a particular application and/or setting.

Some light control systems, in addition to varying light levels (i.e. dimming), may be configured to manipulate the spectral composition of an LED light source to effectively alter the main chromatic properties of the light source. The chromatic properties may include, for example, the appearance of the light source based on brightness and color temperature. The brightness, or illumination level, is a measure of the amount of useable light which is incident on a surface of an object. Color temperature, also referred to herein as correlated color temperature (CCT), is a description of color appearance of a light source in terms of its warmth or coolness. Light sources with a low color temperature generally have a yellow-white color and are described as "warm," while lamps with a high color temperature have a blue-white color and are described as "cool."

While brightness and color temperature are indicators of the color appearance of light, neither describes the mix of wavelengths present an LED light source, an important factor when illuminating objects. Color rendering, another chromatic property of light, is a measure of the quality of light emitted by a light source with regard to the light source's ability to effectively reproduce the color of an illuminated object. As generally understood, the perceived color of an object depends, in part, on the wavelengths emitted by the light source and the wavelengths reflected and absorbed by the object. Generally, an object has reflectance properties, whereby each wavelength in the spectrum of light imparted upon the object is absorbed or reflected to a varying extent. An object will selectively absorb or reflect the wavelengths from the light source, which, in turn, results in a perceived appearance (e.g. color) of the object. As such, the perceived color of an object is highly dependent on the light source and the associated color rendering properties of the light source.

Most applications and settings generally utilize white light for illumination purposes. In recent years, white LEDs have quickly matched and overtaken the efficacy of standard incandescent and fluorescent lighting systems. A challenge in controlling white LED lighting is that, in certain settings and applications, light must be continuously perceived by users as white. However, manipulation of and effects applied to the LED lighting can disturb a user's overall visual experience within a setting.

BRIEF DESCRIPTION OF THE DRAWINGS

Features and advantages of the claimed subject matter will be apparent from the following detailed description of embodiments consistent therewith, which description should be considered with reference to the accompanying drawings, wherein:

Figure 1:
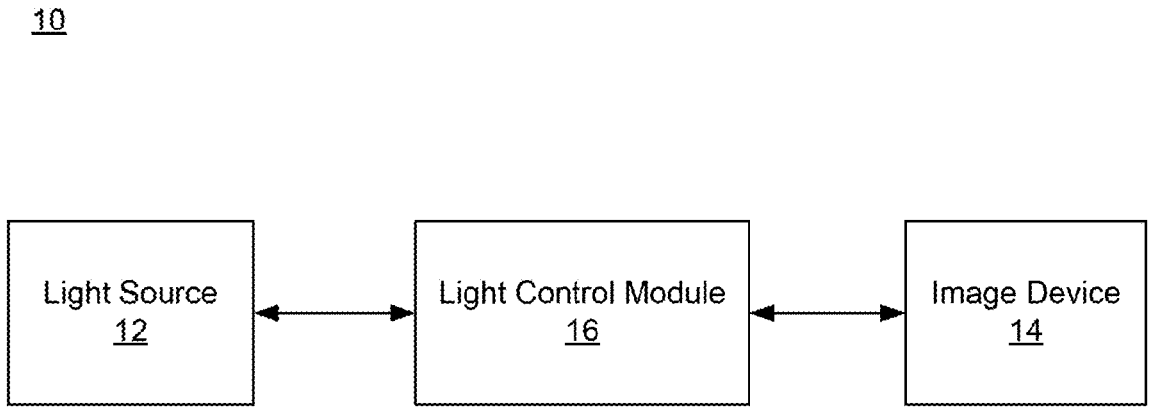
FIG. 1 is a block diagram illustrating one embodiment of a system for controlling lighting consistent with the present disclosure.

For a thorough understanding of the present disclosure, reference should be made to the following detailed description, including the appended claims, in connection with the above-described drawings. Although the present disclosure is described in connection with exemplary embodiments, the disclosure is not intended to be limited to the specific forms set forth herein. It is understood that various omissions and substitutions of equivalents are contemplated as circumstances may suggest or render expedient. Also, it should be understood that the phraseology and terminology used herein is for the purpose of description and should not be regarded as limiting.

DETAILED DESCRIPTION

By way of a brief overview, the present disclosure is generally directed to a system and method for controlling a light source to enhance the appearance of one or more objects within an environment illuminated by the light source. The system includes a tunable white light source, such as a color-mixing multiple LED arrangement. The tunable white light source is configured to emit a plurality of different light outputs, wherein each light output has an associated spectral composition and corresponds to a separate associated one of a plurality of lighting conditions. Each of the plurality of lighting conditions comprises a set of pre-configured values associated with chromatic properties of a spectral composition of an associated light output. The chromatic properties may include at least one of brightness, color temperature and color rendering.

The system further includes a camera configured to capture images of one or more objects within an environment illuminated by one or more of the different light outputs from the light source. Each captured image corresponds to a separate associated one of the different light outputs emitted from the light source. The camera is further configured to detect and identify one or more attributes of at least one of the objects illuminated by each of the different light outputs. The one or more attributes may generally include a set of color values of the at least one object for each of the different light outputs.

The system further includes a light control module configured to identify at least one optimal lighting condition for the light source based, at least in part, on a comparison of the one or more attributes of the at least one object for each of the different light outputs with attributes corresponding to a true color appearance of the at least one object. The optimal lighting condition includes a set of optimal values associated with chromatic properties of a spectral composition of an associated light output configured to provide visual enhancement of the at least one object being illuminated while maintaining an overall appearance of light from the light source within the environment. The light control module is further configured to adjust emission of light output from the light source based on the optimal lighting condition and associated set of optimal values.

Lighting quality is an important factor in most lighting schemes. The most efficient light sources mounted in the best luminaires may save energy, but may not necessarily produce much value for users if they are applied improperly. Accordingly, the ability to efficiently and effectively manipulate the quality of light, particularly the color rendering properties, plays an important factor in certain settings and applications in which the appearance an object is important.

A system consistent with the present disclosure is configured to provide an improved means of illuminating environments and objects within. A system consistent with the present disclosure is configured to identify an optimal lighting condition and adjust one or more properties of the spectral composition of a white light source based on the optimal lighting condition to enhance the appearance, such as the color, of one or more objects within an environment. For example, the adjusted white light may be configured to render the color of an object more saturated and/or brighter, thereby drawing a viewer's attention towards the object, while maintaining the overall white light within the setting, specifically the overall appearance of the light. As such, although the light source can be adjusted to enhance the appearance of a particular illuminated object, the adjustment may have little or no noticeable effect on the viewer's overall perception of the setting.

In addition to enhancing the appearance of a particular illuminated object within the environment, the system may further be configured to identify one or more contrast lighting conditions that provide a variety of different contrast conditions between at least two or more objects illuminated by the white light source. The system may be configured to allow the user to select from one or more contrast lighting conditions that provide varying degrees of contrast between the two or more objects. By providing varying degrees of contrast, the user may cycle through each contrast lighting condition and select a contrast lighting condition that provides the most favorable illumination of the objects for a particular application, specifically illuminating the objects such that an object of interest is more visually distinct from another object that may be of less interest.

A system consistent with the present disclosure can be beneficial in a variety of settings. For example, in a retail setting, the system could be used to enhance the appearance of merchandise on display (e.g. a jewelry display) so as to draw a customer's attention away from the surrounding setting and towards the merchandise (e.g. precious stones), all while maintaining the overall appearance of the white lighting in the surrounding setting. In the medical setting, the system could be used to enhance the appearance of a particular tissue of interest from a nearby or adjacent tissue that is of less interest by providing a variety of contrast lighting conditions. For example, a surgeon performing surgery to remove a particular tissue or tissue type (e.g. cancerous tissue) may utilize the system to provide contrast illumination of the surgery site, providing contrast between the cancerous tissue and surrounding healthy tissue, thereby improving the surgeons ability to visually distinguish between the healthy tissue and cancerous tissue and improve such removal of the cancerous tissue.

Reference will now be made in detail to exemplary embodiments of the disclosure, examples of which are illustrated in the accompanying drawings. Wherever possible, the same reference numbers will be used throughout the drawings to refer to the same or like parts.

Turning now to FIG. 1, one embodiment of a system 10 for controlling a light source consistent with the present disclosure is generally illustrated. The system 10 generally includes a light source 12, an image device 14 and a light control module 16. The system 10 may be included within any setting or environment in which illumination is desired, particularly in settings in which the illumination of objects is important, such as, for example, the illumination of merchandise in a retail setting.

Generally, the light source 12 is configured to provide illumination within an environment and further illuminate one or more objects within the environment. The image device 14 is configured to capture one or more images of at least one object being illuminated by the light source 12 and further determine one or more attributes of the object, including color values of the object. The light control module 16 is configured to receive data related to the object attributes identified by the camera and further determine at least one optimal lighting condition for the light source based, at least in part, on the object attributes. The optimal lighting condition includes a set of values associated with chromatic properties of the light source 12, including brightness, color temperature and color rendering of the light source 12, configured to provide an enhanced appearance of the object while maintaining the overall appearance of emitted light within the environment.

Figure 2:
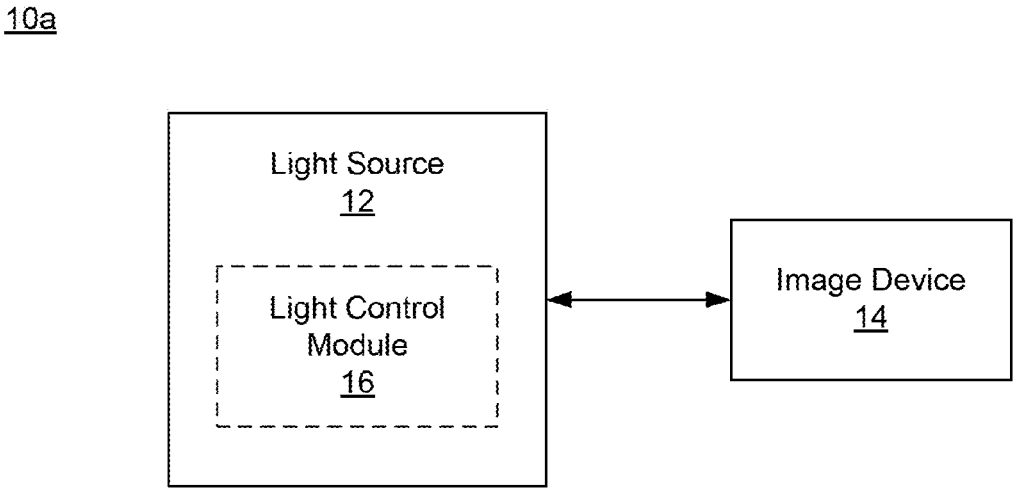
FIG. 2 is a block diagram illustrating another embodiment of a system for controlling lighting consistent with the present disclosure.

In the illustrated embodiment, the light source 12, image device 14 and light control module 16 are separate from one another. It should be noted that in other embodiments, as generally understood by one skilled in the art, the light source 12 may optionally include the light control module 16, as shown in FIG. 2, for example. The optional inclusion of the light control module 16 as part of the light source 12, rather than an element external to light source 12, is denoted in FIG. 2 with broken lines. It should be noted that other configurations may also be possible, including, but not limited to, a device including all elements (light source 12, image device 14 and light control module 16).

Figure 3:
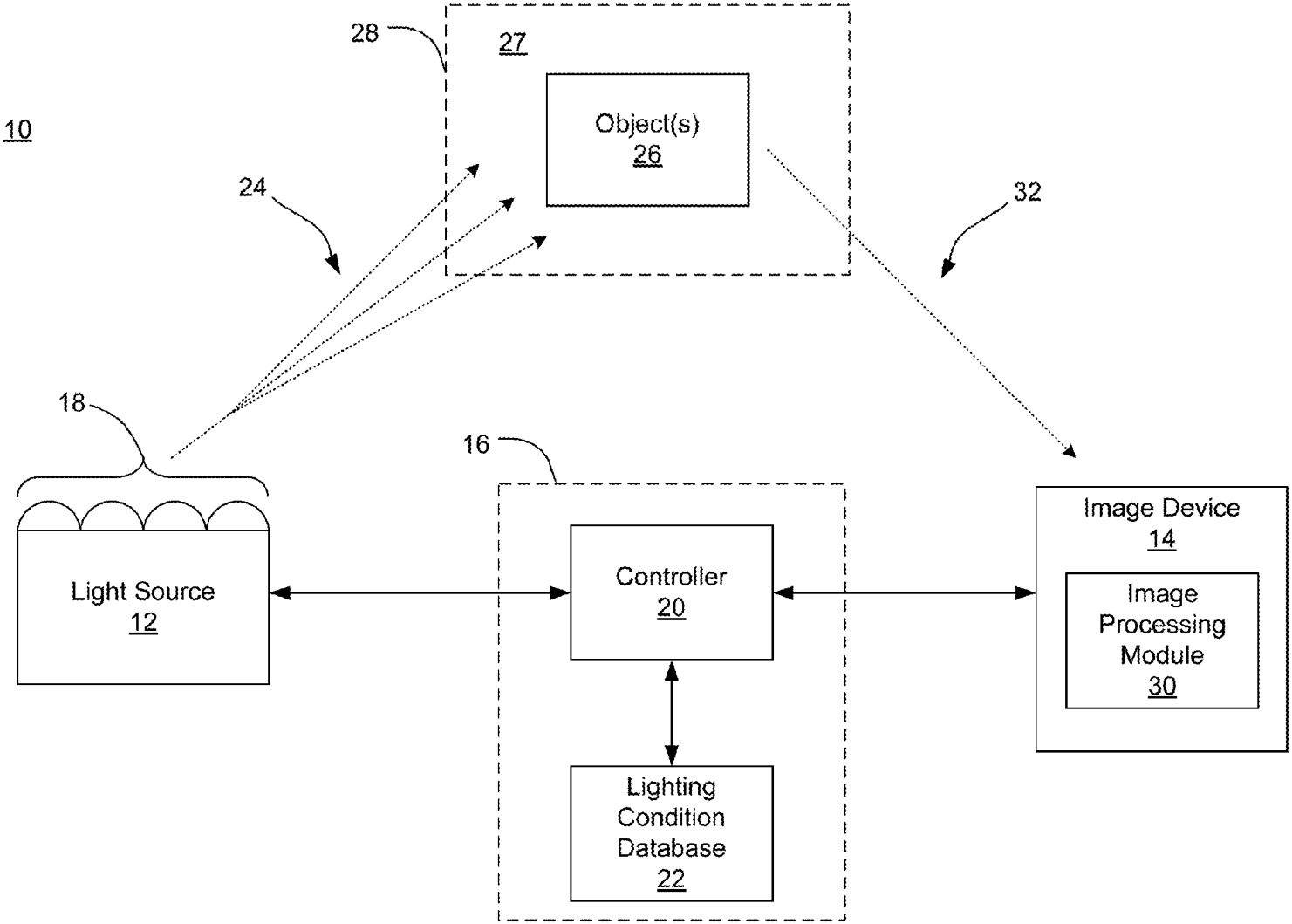
FIG. 3 is a block diagram illustrating the system of FIG. 1 in greater detail.

Turning now to FIG. 3, the system 10 of FIG. 1 is illustrated in greater detail. The light source 12 is a multi-color white light source including a color-mixing multiple LED arrangement 18. As generally understood, the LED arrangement 18 may include a plurality of different color LED chips for emitting light of different respective colors, which are mixed to produce a color-mixed light output (e.g. white light) from the LED arrangement 18. The mixture of light emitted by each of the different color LED chips can cover a large part of the visible spectrum.

As used herein, the term "color" is used interchangeably with the term "spectrum." However, the term, "color" generally is used to refer to a property of radiation that is perceivable by an observer (though this usage is not intended to limit the scope of this term). Accordingly, the term "different colors" implies two different spectra with different wavelength components and/or bandwidths. In addition, "color" may be used to refer to white and non-white light.

For the purpose of this disclosure, the term "color temperature" or "correlated color temperature (CCT)" refers to a particular color content or shade (reddish, bluish, etc.) of white light. The color temperature of a radiation sample is conventionally characterized according to the temperature in degrees Kelvin (K) of a black body radiator that radiates essentially the same spectrum as the radiation under examination.

The term "color rendering" or "color rendering index (CRI)" is a measure of the quality of light emitted by a light source with regard to its ability to effectively reproduce the color of an illuminated object. It is also indicative of the spectral characteristics of the emitted light. More particularly, CRI is a measure of the amount of color shift that objects undergo when lighted by a light source as compared to the color of those same objects when seen under a reference light source of comparable color temperature. CRI is expressed on a scale of 0-100, where 100 may be considered the best for producing colors that are natural and vibrant.

Use of a specific color to describe an LED or the light emitted by the LED refers to a peak or specific range of dominant wavelengths associated with the specific color. For example, the term "super red" when used to describe an LED or the light emitted by the LED means the LED emits light with a peak wavelength of approximately 633 nm and the term "amber-red" refers to red light with a peak wavelength of approximately 617 nm. The term "orange" when used to describe a LED or the light emitted by the LED means the LED emits light with a peak wavelength of approximately 606 nm and the term "yellow" refers to light with a peak wavelength of approximately 590 nm. The term "green" when used to describe a LED or the light emitted by the LED means the LED emits light with a dominant wavelength between 495 nm and 570 nm and the term "mint" refers to white light and/or substantially white light that has a greenish element to the white light such that it is above the Planckian curve and is in and/or substantially in the green color space of the 1931 CIE chromaticity diagram. The term "blue" when used to describe a LED or the light emitted by the LED means the LED emits light with a dominant wavelength between 430 nm and 490 nm.

The term "white" generally refers to white light with a CCT between about 2600 and 8000 K, "cool white" refers to light with a CCT closer to 8000 K, which is more bluish in color, and "warm white" refers to white light with a CCT of between about 2600 K and 4000 K, which is more reddish in color.

The color-mixing multiple LED arrangement 18 of the light source 12 is configured to emit and mix different colors of light. As shown, the light control module 16 includes a controller 20 configured to control each colored LED of the LED arrangement 18. In particular, the composite output spectrum of the light source 12 can be adjusted by the controller 20 based on preprogrammed lighting conditions of a lighting condition database 22 so as to create light of varying characteristics. Each lighting condition includes a set of preconfigured values associated with chromatic properties, including illumination, CCT and CRI levels, resulting in an associated output spectra. The controller 20 is configured to control the LED arrangement 18 so that the light source 12 emits a white light. For example, the LED arrangement 18 may include red-, green-, blue-, and yellow-emitting LEDs, as well as other color LEDs, such as amber and mint, wherein each colored LED is individually controlled by the controller 20 and mixed so as to produce an overall white light output, as indicated by arrow 24.

In the illustrated embodiment, the light source 12 is configured to emit light, indicated by arrow 24, to illuminate one or more objects 26 as well as a background 27 within an environment 28. As previously described, the environment 28 may include, for example, a retail setting and the one or more objects 26 may include merchandise. In these settings, it may be desirable to enhance the appearance at least one of the objects 26 so as to draw a viewer's attention away from the background 27 and towards the desired object 26. In order to enhance the appearance of the object 26, the "true color" of the object must necessarily be determined. The term "true color" generally refers to characteristics of the object 26, including color values of the object 26, when the object 26 is subjected to a quasi-blackbody illumination (standard lamp illumination).

Accordingly, in order to first determine the true color of at least one of the objects 26, the controller 20 may be configured to adjust the output spectrum of the light source 12 based on a calibration lighting condition. The calibration lighting condition may generally result in the light source 12 generating a quasi-continuous spectrum of >98 CRI. As generally understood, CRI is expressed on a scale of 0-100, where 100 may be considered the best for producing colors that are natural and vibrant. The image device 14 may be configured to capture one or more images representative of the environment 28, including one or more objects 26 and background 27 within. The image device 14 includes any device (known or later discovered) for capturing digital images representative of an environment that may include one or more objects, and may have adequate resolution for the detection of the objects within, including analysis of such objects, including identification of the object attributes as described herein. For the purposes of clarity and ease of description, the image device 14 will hereinafter be referred to as a camera 14.

The camera 14 may include a still camera (e.g., camera configured to capture still photographs) or video camera (e.g., cameras configured to capture moving images comprised of a plurality of frames). The camera 14 may be configured to operate using light in the visible spectrum or with other portions of the electromagnetic spectrum (e.g., but not limited to, the infrared spectrum, ultraviolet spectrum, etc.). The camera 14 may be configured to communicate with the light source 12 and light control module 16 via wired or wireless communication. Specific examples of a camera 14 may include wired (e.g., Universal Serial Bus (USB), Ethernet, Firewire, etc.) or wireless (e.g., WiFi, Bluetooth, etc.) web cameras (as may be associated with a personal computer and/or TV monitor), handheld device camera (e.g., cell phone camera, smart phone camera (e.g., camera associated with the iPhone®, Trio®, Blackberry®, etc.), laptop computer camera, tablet computer (e.g., but not limited to, iPad®, Galaxy Tab®, and the like), e-book reader (e.g., but not limited to, Kindle®, Nook®, and the like), etc.

Figure 4:
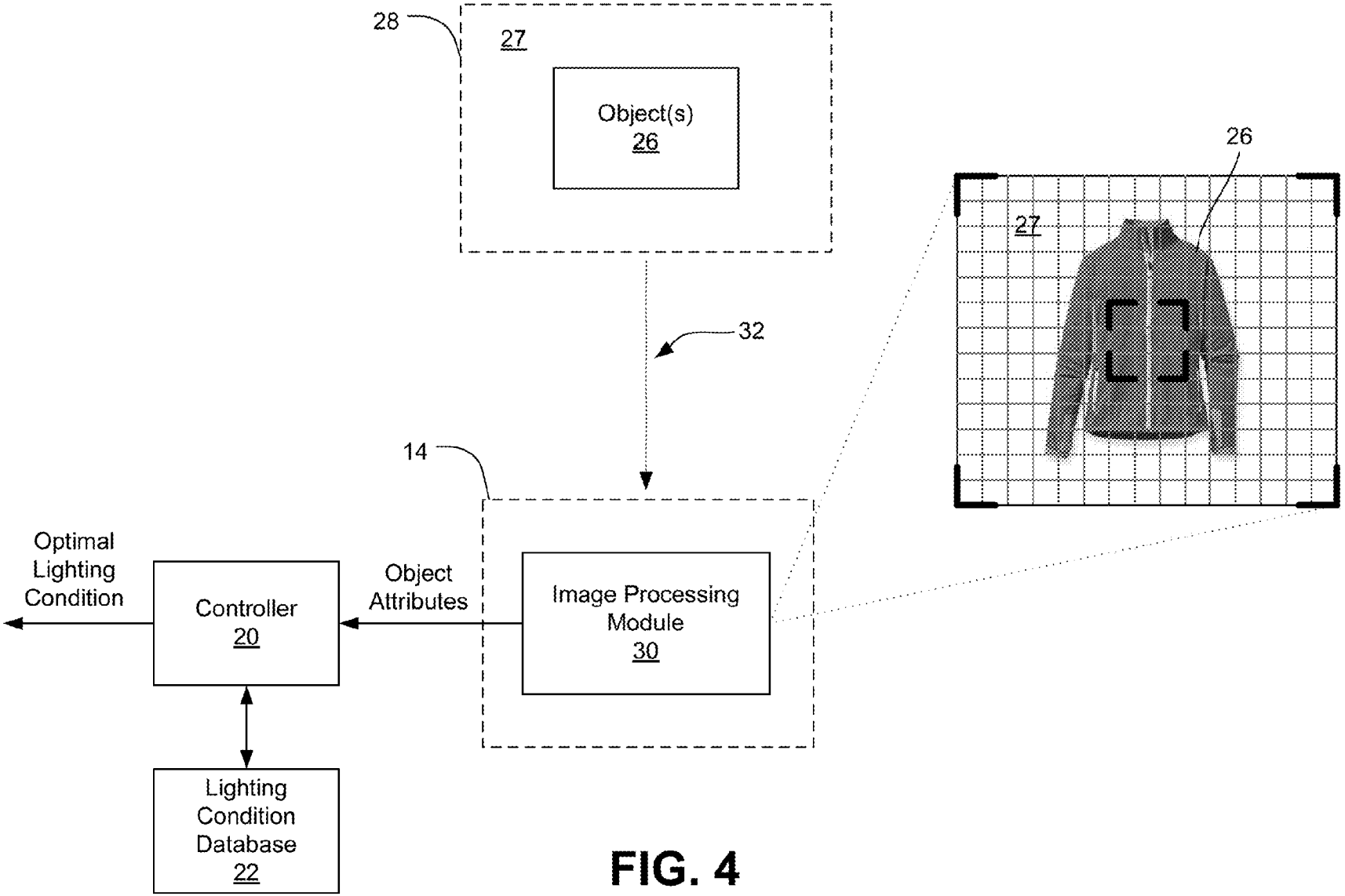
FIG. 4 is a block diagram illustrating one embodiment of an image device consistent with various embodiments of the present disclosure.

The camera 14 may include a charge-coupled device (CCD) type camera. As generally understood, the camera 14 may be configured to capture standard format RGB images. The camera 14 includes an image processing module 30 configured to process the image to detect and identify attributes of one or more objects 26 in the image. In particular, the image processing module 30 may include custom, proprietary, known and/or after-developed code (or instruction sets, functions, etc.) that are generally well-defined and operable to process pixels of an image in one or more color spaces to identify values of each pixel for each color space. For example, the image processing module 30 may include an XYZ filter configured to convert the image to XYZ color space and further enable processing of pixels of a region of the image containing the one or more objects 26 and identify values of each pixel for the XYZ color space, including, but not limited to, luminance as CIE x, y color points. In particular, the image processing module 30 may be configured to generate a spatial mapping of CIE x, y color points and luminance, as generally shown in FIG. 4. Accordingly, the image processing module 30 may be configured to identify color values of at least one of the objects 26.

The camera 14 and light source 12 may be synchronously coupled with one another, such that the camera 14 is configured to capture one or more images of the one or more objects 26 each time the light source 12 is adjusted to a different lighting condition and emits light having an associated spectra. In some embodiments, the light source 12 may be configured to emit pulses or flashes of light having an associated spectra, and the camera 14 is synchronized with the light source 12 such that the camera may capture and process images of the one or more objects 26 associated with each pulse or flash of light.

As previously described, in order to first determine the true color of at least one of the objects 26, the controller 20 adjusts the output spectrum of the light source 12 via the calibration lighting condition, resulting in the light source 12 generating a quasi-continuous spectrum of >98 CRI. In turn, the camera 14 captures an image of the environment 28, including the object 26 and background 27 within, exposed to the quasi-continuous spectrum of >98 CRI. Based on the object's reflection of the wavelengths imparted thereon by the light source 12, as indicated by arrow 32, the image processing module 30 of the camera 14 is configured to identify attributes of the object 26, including color values, indicative of the true color of the object 26.

Upon processing the image, the image processing module 30 is configured to transmit the true color values of the object 26 to the controller 20 of the light control module 16, wherein the true color values may be stored within the lighting condition database 22 for use as a reference point in determining the optimal lighting condition for the light source 12, as described in greater detail herein. At this point, the true color appearance of the object 26 has now been established and the system can progress in determining optimal lighting conditions for enhancing the appearance of the object 26.

Upon establishing the object attributes, particularly color values, associated with the true color of the object 26, the controller 20 is configured to adjust the output spectrum of the light source 12 based on each of the preprogrammed lighting conditions from the lighting condition database 22. As previously described, each preprogrammed lighting condition includes a set of pre-configured values associated with chromatic properties, including illumination, CCT and CRI levels. Accordingly, each lighting condition results in a different associate output spectra emitted from the light source 12. Each output spectra may accentuate various parts of the spectrum for a wide range of colored objects under a variety of CCT conditions. Because the light source 12 and camera 14 are synchronized with one another, the camera 14 is configured to capture and process one or more images of the object 26 for each output spectra (e.g. lighting condition) and further identify object attributes, include object color values, resulting from each lighting condition and associated output spectra.

The controller 20 may be configured to cycle through some or all of the lighting conditions stored in the database 22 in order to establish one or more optimal lighting conditions. The time associated with each light condition of the light source 12 and subsequent measurement of values by the camera 14 may be on the order of milliseconds. Accordingly, in the event that the database 22 that includes hundreds or thousands of lighting conditions, the evaluation of each of the lighting conditions may only take seconds in order to obtain the optimal lighting condition.

As shown in FIG. 4, the image processing module 30 of the camera 14 is configured to process pixels of a region of the image containing the object 26 and identify values of each pixel for the XYZ color space, including, but not limited to, luminance as CIE x, y color points. In particular, as shown, the image processing module 30 may be configured to generate a spatial mapping of CIE x, y color points and luminance. In the illustrated embodiment, an example 15×13 pixel field is nominally mapped into a 3×3 pixel "object" field and a remaining "background" field. In one embodiment, the image processing module 30 may be configured to focus processing of the pixels within the 3×3 pixel "object" field only, so as to decrease processing time.

The control module 20 is configured to receive data related to the identified object attributes for each lighting condition and determine at least one optimal lighting condition for the light source 12 based, at least in part, on a comparison of the object attributes for each lighting condition with the established object attributes, including color values, associated with the true color appearance of the object 26. In particular, the controller 20 may compare the color values of the object 26 for each lighting condition with the true color values of the object 26, and, if color values fall within a predetermined tolerance level, then the associated lighting condition may be considered an optimal lighting condition. The controller 20 may then be configured to store one or more optimal lighting conditions in the database 22.

The associated spectra of the optimal lighting condition may result in illuminating the object 26 such that the object's true color appearance is matched with little or no efficacy loss of a continuous illumination spectrum and/or the appearance of the object is enhanced, which may include a more saturated color of the object or increased contrast of the object, thereby causing the object 26 to stand out from the background 27, thereby drawing a viewer's attention.

Although not shown, the system 10 may further include an interface upon which the user may be able to select from one of the optimal lighting conditions. For example, in one embodiment, the system 10 may include a user interface in which the user may be presented with one or more optimal lighting conditions and may select one to view the appearance of the object 26 resulting from the output spectra associated with the selected optimal lighting condition. It should be noted that in other embodiments, the system 10 may be configured to automatically select the most optimal lighting condition.

In other embodiments, the system 10 may be configured to establish the object's reflectivity (indicated by arrow 32) by illuminating the object 26 with each of the colored LEDs of the LED arrangement 18, individually one at a time. For each individual colored LED, the camera 14 is configured to capture an image of the object 26 and identify object attributes. The system 10 may further be configured to quantify a color reflectivity spectrum of the object 26 and further determine the optimal spectra for the light source 12 based on the color reflectivity spectrum. Accordingly, this method is based on a calculation to predict the appearance of the object under different spectra of the light source 12 as opposed to the trial and error process of cycling through and evaluating each of the plurality of lighting conditions in the database 22. However, predicting the appearance of the object based on this calculation necessarily results in performance and/or appearance compromises.

In addition to enhancing the appearance of a particular illuminated object within an environment, as generally described above, a system consistent with the present disclosure may also be configured to provide contrast between two or more objects 26 within the environment 28, so as to improve the user's ability to visually distinguish between the two or more objects 26. As described in greater detail herein, the system may be configured to control output of the light source 12 based on one or more contrast lighting conditions to provide varying degrees of contrast between at least two objects 26 illuminated by the light source 12. The system may generally allow the user to cycle through each contrast lighting condition and select a contrast lighting condition that provides the most favorable illumination of the at least two objects 26 for a particular application.

The system for providing contrast between two or more objects may be applicable in a variety of settings in which a user would like to visually distinguish between two objects. For example, in the medical field, the system could be used to enhance the appearance of a particular tissue of interest from a nearby or adjacent tissue that is of less interest by providing a variety of contrast lighting conditions. In turn, a surgeon, for example, may cycle through each contrast lighting condition and identify a lighting condition that provides a most preferred contrast between the at least two objects (e.g. cancerous tissue from non-cancerous tissue). Another example may include the fashion industry, in which the system could be used to enhance the appearance of a desired article of clothing in relation to another separate article of clothing (e.g. enhance the appearance of a blouse over the appearance of a skirt). Similarly, the system could be used to enhance the appearance an article of clothing over a model's skin tone on a runway.

The system for providing contrast may generally include like components as the previously described system for enhancing the appearance of a particular illuminated object, and, as such, the like components are generally configured to operate in a similar manner. As previously described, the light source 12 is configured to provide illumination within an environment and further illuminate one or more objects within the environment and the camera 14 is configured to capture one or more images of the one or more objects illuminated by the light source 12. In this instance, the light source 12 and camera 14 may be specifically focused on two objects within a field of view.

The controller 20 is configured to adjust the output spectrum of the light source 12 based on contrast lighting conditions of the lighting condition database 22 so as to create light of varying characteristics resulting in varying contrast between the two objects. Each contrast lighting condition includes a set of pre-configured values associated with chromatic properties, including illumination, CCT and CRI levels, resulting in an associated output spectra. For example, each contrast lighting condition may include color balance at a fixed CCT, or varying CCT. Because the light source 12 and camera 14 are synchronized with one another, the camera 14 is configured to capture and process one or more images of the two objects 26 for each output spectra (e.g. contrast lighting condition) and further identify attributes of each of the two objects resulting from each contrast lighting condition and associated output spectra.

Similar to the process described in reference to FIG. 4, the image processing module 30 of the camera 14 is configured to process pixels of a region of the image containing the two objects and identify values of each pixel for the XYZ color space, including, but not limited to, luminance as CIE x, y color points. In particular, the image processing module 30 may be configured to generate a spatial mapping of CIE x, y color points and luminance to focus processing of pixels within field of the two objects only. The identified values may be indicative of contrast between the two objects.

The control module 20 is configured to receive data related to the identified attributes of each of the two objects for each contrast lighting condition and determine at least one contrast lighting condition generating a high degree of contrast between the two objects. For example, the control module 20 may include custom, proprietary, known and/or after-developed contrast code (or instruction sets, functions, etc.) that are generally well-defined and operable to analyze the identified attributes of each of the two objects, including identified pixel values, and determine contrast between the two objects. The control module 20 may determine that a contrast lighting condition generates a high degree of contrast if the data related to the identified attributes associated with the contrast lighting condition meets or exceeds a predefined contrast threshold, as determined by any known contrast determination algorithms. In the event that the data falls below the predefined contrast threshold, the associated contrast lighting condition is not considered to provide high contrast. The controller 20 may then be configured to store one or more identified high contrast lighting conditions in the database 22.

The associated spectra of the high contrast lighting condition may result in illuminating the two objects such that each object may be visually distinct from the other, thereby allowing each object to stand out from the other. The system may be configured to allow the user to select from one or more high contrast lighting conditions that provide varying degrees of contrast between the two or more objects. By providing varying degrees of contrast, the user may cycle through each high contrast lighting condition and select a high contrast lighting condition that provides the most favorable illumination of the objects for a particular application.

It should also be noted that the control module 20 may be configured to determine at least one contrast lighting condition resulting in an output spectra generating the lowest degree of contrast. In some applications, it may be desirable to have illumination that provides low contrast between two or more objects. For example, in a user may wish to have a "lowest contrast" lighting condition for the purpose of deliberately de-accenting blemishes in an object, such as, for example, freckles on a face.

Figure 5:
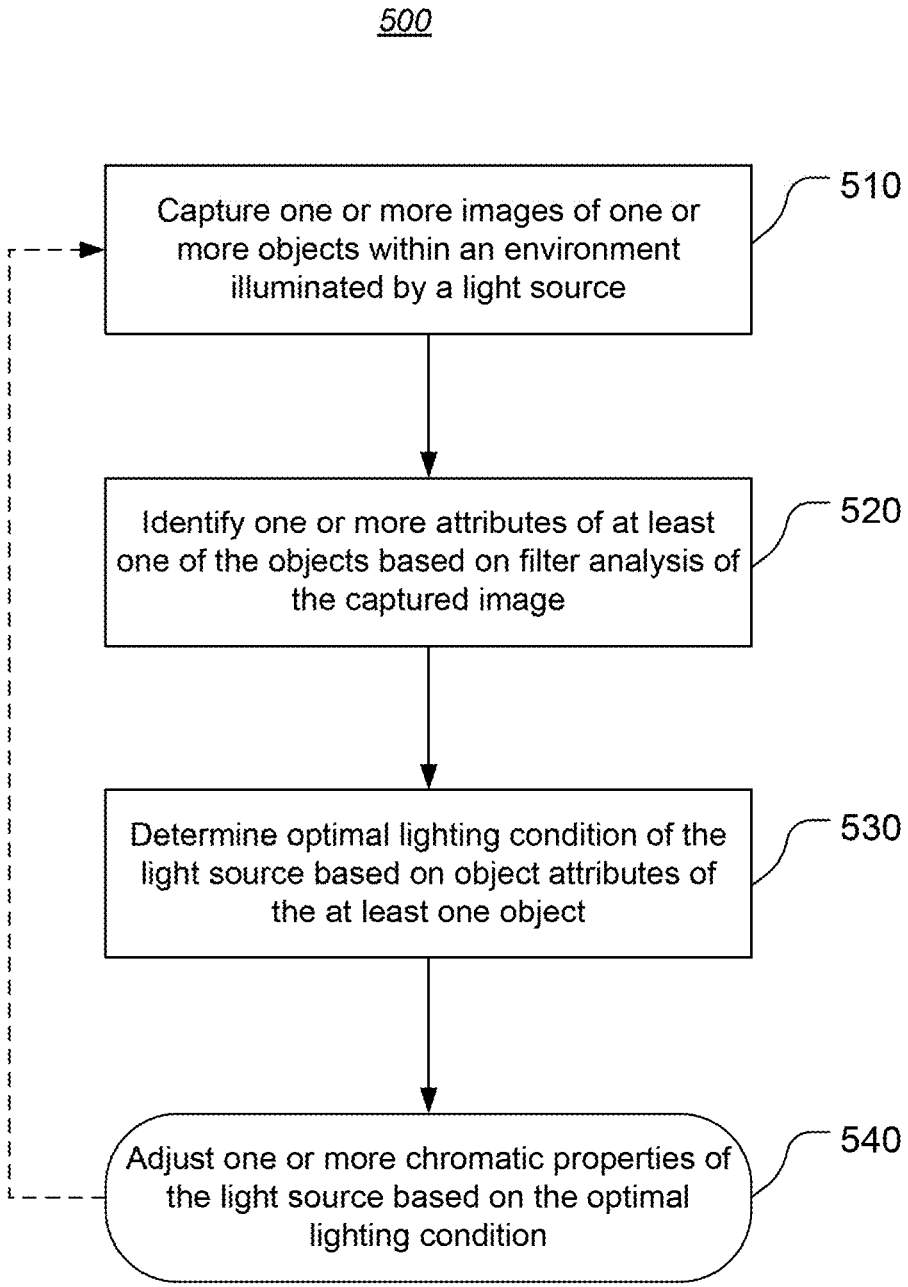
FIG. 5 is a block flow diagram illustrating one embodiment of a method for controlling a light source to enhance the appearance of an object illuminated by the light source consistent with the present disclosure.

Turning now to FIG. 5, a flowchart of one embodiment of a method 500 for controlling a light source to enhance the appearance of an object illuminated by the light source consistent with the present disclosure is illustrated. The method 500 includes capturing one or more images of one or more objects within an environment illuminated by a light source (operation 510). The images may be captured by a camera. The camera may be further configured to identify one or more attributes of at least one of the objects based on filter analysis of the captured image (operation 520). In particular, the camera may be configured to filter each pixel of the image, particularly in a region of the image in which the at least one object is present and determine values associate with each pixel representing the at least one object, including object color values (CIE color coordinates (x, y)) as well as luminance.

One or more optimal lighting conditions of the light source may be determined based on the object attributes of the at least one object (operation 530). In particular, in one embodiment, object attributes may be compared with known set of "true color" attributes of the object, and, based on the comparison, an optimal lighting condition may be determined. The optimal lighting condition includes a set of values associated with chromatic properties of the light source, including brightness, color temperature and color rendering, wherein the optimal lighting condition is configured to enhance the appearance of the at least one objects illuminated by the light source while maintaining the overall appearance of light within the environment. The method 500 further includes adjusting one or more chromatic properties of the light source based on the optimal lighting condition (operation 540) to enhance the appearance of the at least one object within the environment.

While FIG. 5 illustrates method operations according to various embodiments, it is to be understood that in any embodiment not all of these operations are necessary. Indeed, it is fully contemplated herein that in other embodiments of the present disclosure, the operations depicted in FIG. 5 may be combined in a manner not specifically shown in any of the drawings, but still fully consistent with the present disclosure. Thus, claims directed to features and/or operations that are not exactly shown in one drawing are deemed within the scope and content of the present disclosure.

Additionally, operations for the embodiments have been further described with reference to the above figures and accompanying examples. Some of the figures may include a logic flow. Although such figures presented herein may include a particular logic flow, it can be appreciated that the logic flow merely provides an example of how the general functionality described herein can be implemented. Further, the given logic flow does not necessarily have to be executed in the order presented unless otherwise indicated. In addition, the given logic flow may be implemented by a hardware element, a software element executed by a processor, or any combination thereof. The embodiments are not limited to this context.

A system consistent with the present disclosure provides a user with the ability to strategically control the output of a multi-color white light source including a color-mixing multiple LED arrangement to enhance the appearance of one or more objects illuminated by the light source without compromising the overall appearance of the white light and possibly affecting the viewer's overall perception.

A system consistent with the present disclosure can be beneficial in a variety of settings. In addition to the benefits in retail and medical settings, previously described herein, the system could be beneficial in settings in which visual acuity is highly desirable. For example, in the surveillance field, the system could be used to enhance the appearance of a scene of a crime in an image or video, such as the face of one or more persons during the commission of a crime. The system could provide a means of enhancing the image or video to aid in the investigation of the crime.

Various features, aspects, and embodiments have been described herein. The features, aspects, and embodiments are susceptible to combination with one another as well as to variation and modification, as will be understood by those having skill in the art. The present disclosure should, therefore, be considered to encompass such combinations, variations, and modifications. Thus, the breadth and scope of the present disclosure should not be limited by any of the above-described exemplary embodiments, but should be defined only in accordance with the following claims and their equivalents.

As used in any embodiment herein, the term "module" may refer to software, firmware and/or circuitry configured to perform any of the aforementioned operations. Software may be embodied as a software package, code, instructions, instruction sets and/or data recorded on non-transitory computer readable storage medium. Firmware may be embodied as code, instructions or instruction sets and/or data that are hard-coded (e.g., nonvolatile) in memory devices. "Circuitry", as used in any embodiment herein, may comprise, for example, singly or in any combination, hardwired circuitry, programmable circuitry such as computer processors comprising one or more individual instruction processing cores, state machine circuitry, and/or firmware that stores instructions executed by programmable circuitry. The modules may, collectively or individually, be embodied as circuitry that forms part of a larger system, for example, an integrated circuit (IC), system on-chip (SoC), desktop computers, laptop computers, tablet computers, servers, smart phones, etc.

Any of the operations described herein may be implemented in a system that includes one or more storage mediums having stored thereon, individually or in combination, instructions that when executed by one or more processors perform the methods. Here, the processor may include, for example, a server CPU, a mobile device CPU, and/or other programmable circuitry. Also, it is intended that operations described herein may be distributed across a plurality of physical devices, such as processing structures at more than one different physical location. The storage medium may include any type of tangible medium, for example, any type of disk including hard disks, floppy disks, optical disks, compact disk read-only memories (CD-ROMs), compact disk rewritables (CD-RWs), and magneto-optical disks, semiconductor devices such as read-only memories (ROMs), random access memories (RAMs) such as dynamic and static RAMs, erasable programmable read-only memories (EPROMs), electrically erasable programmable read-only memories (EEPROMs), flash memories, Solid State Disks (SSDs), magnetic or optical cards, or any type of media suitable for storing electronic instructions. Other embodiments may be implemented as software modules executed by a programmable control device. The storage medium may be non-transitory.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Accordingly, the claims are intended to cover all such equivalents. Various features, aspects, and embodiments have been described herein. The features, aspects, and embodiments are susceptible to combination with one another as well as to variation and modification, as will be understood by those having skill in the art. The present disclosure should, therefore, be considered to encompass such combinations, variations, and modifications.

As described herein, various embodiments may be implemented using hardware elements, software elements, or any combination thereof. Examples of hardware elements may include processors, microprocessors, circuits, circuit elements (e.g., transistors, resistors, capacitors, inductors, and so forth), integrated circuits, application specific integrated circuits (ASIC), programmable logic devices (PLD), digital signal processors (DSP), field programmable gate array (FPGA), logic gates, registers, semiconductor device, chips, microchips, chip sets, and so forth.

Reference throughout this specification to "one embodiment" or "an embodiment" means that a particular feature, structure, or characteristic described in connection with the embodiment is included in at least one embodiment. Thus, appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

According to one aspect, there is provided a system for controlling lighting. The system includes a tunable white light source configured to emit a plurality of different light outputs, each light output having an associated spectral composition and corresponding to a separate associated one of a plurality of lighting conditions stored in a lighting condition database. The system further includes a camera configured to capture images of one or more objects within an environment illuminated by each of the different light outputs from the light source, each image corresponding to a separate associated one of the different light outputs. The camera is configured to process the image and identify one or more attributes of at least one of the objects for each of the different light outputs. The system further includes a light control module configured to identify at least one optimal lighting condition based, at least in part, on a comparison of the attributes of the at least one object for each of the light outputs with attributes corresponding to a true color appearance of the at least one object.

According to another aspect, there is provided a system for controlling lighting. The system includes a tunable white light source configured to emit a plurality of different light outputs, each light output having an associated spectral composition and corresponding to a separate associated one of a plurality of lighting conditions stored in a lighting condition database. The system further includes a camera configured to capture images of at least two objects illuminated by each of the different light outputs from the light source, each image corresponding to a separate associated one of the different light outputs. The camera is configured to process the image and identify attributes of each of the two objects for each of the different light outputs. The system further includes a light control module configured to identify at least one lighting condition providing optimal contrast between the two objects based, at least in part, on the attributes of each of the two objects.

According to yet another aspect of the present disclosure, there is provided a method for controlling light. The method includes illuminating, by a tunable white light source, one or more objects within an environment by one or more of a plurality of different light outputs emitted from the tunable white light source, each light output having an associated spectral composition and corresponding to a separate associated one of a plurality of lighting conditions stored in a lighting condition database. The method further includes capturing, by a camera, images of the one or more objects within the environment illuminated by each of the different light outputs from the light source, each image corresponding to a separate associated one of the different light outputs. The method further includes identifying, by the camera, one or more attributes of at least one of the objects for each of the different light outputs. The method further includes identifying, by a light control module, at least one optimal lighting condition based, at least in part, on a comparison of the attributes of the at least one object for each of the light outputs with attributes corresponding to a true color appearance of the at least one object.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Accordingly, the claims are intended to cover all such equivalents.

What is claimed is:

1. A system for controlling lighting, said system comprising:

a tunable white light source configured to emit a plurality of different light outputs, each light output having an associated spectral composition and corresponding to a separate associated one of a plurality of lighting conditions stored in a lighting condition database;

a camera configured to capture images of one or more objects within an environment illuminated by each of said different light outputs from said light source, each image corresponding to a separate associated one of said different light outputs, said camera being configured to process said image and identify one or more attributes of at least one of said objects for each of said different light outputs wherein said camera comprises an image processing module configured to process pixels of each captured image in one or more color spaces to identify values of each pixel for each color space and wherein said image processing module is configured to generate a spatial mapping of CIE x, y color points and luminance for each pixel and identify color values of said at least one object based on said spatial mapping and said light control module is configured to compare sets of color values of said at least one object for each light output with a set of color values corresponding to the true color of said at least one object, wherein, if a set of color values falls within a predetermined tolerance level, said light control module is configured to identify a lighting condition corresponding to a light output associated with said set of color values as an optimal lighting condition; and a light control module configured to identify at least one optimal lighting condition based, at least in part, on a comparison of said attributes of said at least one object for each of said light outputs with attributes corresponding to a true color appearance of said at least one object.

2. The system of claim 1, wherein each of said plurality of lighting conditions comprises a set of pre-configured values associated with chromatic properties of a spectral composition of an associated light output, wherein said chromatic properties are selected from the group consisting of brightness, color temperature and color rendering.

3. The system of claim 2, wherein said at least one optimal lighting condition comprises a set of optimal values associated with chromatic properties of a spectral composition of an associated light output configured to provide visual enhancement of said at least one object while maintaining an overall appearance of light from said light source within said environment.

4. The system of claim 1, wherein said camera and said light source are synchronously coupled to one another, said camera being configured to capture one or more images of said one or more objects for each light output emitted by said light source.

5. The system of claim 4, wherein said light source is configured to emit one or more of said plurality of different light outputs in a pulsing or flashing pattern and said camera is configured to capture and process an image of said one or more objects associated with each pulse or flash of light output.

6. The system of claim 1, wherein said light control module is configured to control emission of light from said light source, said light control module being configured to adjust spectral composition of light from said light source based each of said plurality of lighting conditions to generate corresponding light outputs.

7. The system of claim 1, wherein said light source comprises a color-mixing multiple LED arrangement having a plurality of different color LEDs configured to emit light of different associated colors, wherein said light control module is configured to individually control each color LED and mix said colors to produce white light.

8. The system of claim 1, wherein said camera is configured to identify said attributes corresponding to said true color appearance of said at least one object based on illumination of said at least one object by a calibration light output emitted from said light source corresponding to a calibration lighting condition, wherein said calibration light output comprises quasi-continuous spectrum of >98 color rendering index.

9. A system for controlling lighting, said system comprising:

a tunable white light source configured to emit a plurality of different light outputs, each light output having an associated spectral composition and corresponding to a separate associated one of a plurality of lighting conditions stored in a lighting condition database;

a camera configured to capture images of at least two objects illuminated by each of said different light outputs from said light source, each image corresponding to a separate associated one of said different light outputs, said camera being configured to process said image and identify attributes of each of said two objects for each of said different light outputs; and a light control module configured to identify at least one lighting condition providing optimal contrast between said two objects based, at least in part, on said attributes of each of said two objects, wherein said camera comprises an image processing module configured to process pixels of each captured image of each of said two objects in one or more color spaces to identify values of each pixel for each color space, wherein said light control module is configured to compare sets of color values of each of said two objects for each light output with a set of color values corresponding to the true color of said at least one of said two objects, wherein, if a set of color values falls within a predetermined tolerance level, said light control module is configured to identify a lighting condition corresponding to a light output associated with said set of color values as an optimal lighting condition.

10. The system of claim 9, wherein each of said plurality of lighting conditions comprises a set of pre-configured values associated with chromatic properties of a spectral composition of an associated light output, wherein said chromatic properties are selected from the group consisting of brightness, color temperature and color rendering.

11. The system of claim 10, wherein said at least one lighting condition providing optical contrast comprises a set of values associated with chromatic properties of a spectral composition of an associated light output configured to provide a contrast level for each of said two objects that results in each of said two objects being visually distinguishable from one another.

12. The system of claim 10, wherein said at least one lighting condition providing optical contrast comprises a set of values associated with chromatic properties of a spectral composition of an associated light output configured to provide a contrast level for each of said two objects that results in each of said two objects being visually indistinguishable from one another.

13. A method for controlling light, said method comprising:

illuminating, by a tunable white light source, one or more objects within an environment by one or more of a plurality of different light outputs emitted from said tunable white light source, each light output having an associated spectral composition and corresponding to a separate associated one of a plurality of lighting conditions stored in a lighting condition database;

capturing, by a camera, images of said one or more objects within said environment illuminated by each of said different light outputs from said light source, each image corresponding to a separate associated one of said different light outputs;

identifying, by said camera, one or more attributes of at least one of said objects for each of said different light outputs;

identifying, by a light control module, at least one optimal lighting condition based, at least in part, on a comparison of said attributes of said at least one object for each of said light outputs with attributes corresponding to a true color appearance of said at least one object;

processing, by an image processing module, pixels of each captured image in one or more color spaces and identifying values of each pixel for each color space; and identifying color points and luminance for each pixel and identify color values of said one or more objects; and comparing sets of color values of said at least one object for each light output with a set of color values corresponding to the true color of said one or more objects, wherein, if a set of color values falls within a predetermined tolerance level, said light control module is configured to identify a lighting condition corresponding to a light output associated with said set of color values as an optimal lighting condition.

14. The method of claim 13, wherein said at least one optimal lighting condition comprises a set of optimal values associated with chromatic properties of a spectral composition of an associated light output configured to provide visual enhancement of said at least one object while maintaining an overall appearance of light from said light source within said environment, wherein said chromatic properties are selected from the group consisting of brightness, color temperature and color rendering.

15. The method of claim 13, further comprising adjusting emission of light output from said light source based on said optimal lighting condition and associated set of optimal values.

16. The method of claim 13, wherein said identifying one or more object attributes of said at least one object comprises:

processing, by an image processing module, pixels of each captured image in one or more color spaces and identifying values of each pixel for each color space.

17. The method of claim 16, wherein said processing pixels of each captured image comprises:

generating, by said image processing module, a spatial mapping of CIE x, y color points and luminance for each pixel and identifying color values of said at least one object based on said spatial mapping.

18. The method of claim 13, wherein said camera and said light source are synchronously coupled to one another, said light source being configured to emit one or more of said plurality of different light outputs in a pulsing or flashing pattern and said camera being configured to capture and process an image of said objects associated with each pulse or flash of light output.

* * * * *